US006482058B2

(12) United States Patent
Sanso et al.

(10) Patent No.: US 6,482,058 B2
(45) Date of Patent: Nov. 19, 2002

(54) PERSONAL FLOTATION DEVICE APPARATUS WITH HAND-HELD TOOL

(76) Inventors: David W. Sanso, 6598 W. Oregon Ave., Lakewood, CO (US) 80226; James Preston Oxenham, 562 E. Arden Cir., Highlands Ranch, CO (US) 80126

( * ) Notice: Subject to any disclaimer, the term of this patent is extended or adjusted under 35 U.S.C. 154(b) by 0 days.

(21) Appl. No.: 09/427,295

(22) Filed: Oct. 26, 1999

(65) Prior Publication Data

US 2001/0049240 A1 Dec. 6, 2001

Related U.S. Application Data

(63) Continuation-in-part of application No. 08/840,207, filed on Apr. 11, 1997, now Pat. No. 5,971,823.

(51) Int. Cl.[7] ..... A63B 31/10

(52) U.S. Cl. ..... 441/56; 440/101; 441/129; 446/153

(58) Field of Search ..... 441/55, 56, 129, 441/130, 136; 440/101; 472/128, 129; 446/153; 222/78

(56) References Cited

U.S. PATENT DOCUMENTS 4,328,761 A * 5/1982 Dwyer ..... 114/222
6,027,393 A * 5/1982 O'Rourke ..... 441/136
4,690,651 A * 9/1987 Samson et al. ..... 441/56
4,768,774 A * 9/1988 Beasley ..... 441/78
4,932,912 A * 6/1990 Combs ..... 441/129
5,114,371 A * 5/1992 Alonzo ..... 441/56
5,231,951 A * 8/1993 Tagar et al. ..... 114/345
5,233,705 A * 8/1993 Coleman et al. ..... 441/129
5,282,557 A * 2/1994 McCook ..... 224/148
5,947,782 A * 9/1999 Siladke et al. ..... 441/129
5,971,823 A * 10/1999 Sanso ..... 441/88

* cited by examiner

*Primary Examiner*—Sherman Basinger

(57) ABSTRACT

An end portion of an elongate personal flotation device includes a hand-held tool. In one embodiment, a hand-held tool head assembly has a mounting cup with a cylindrical wall and a flat cup base. The cup is fitted over an end portion of a flexible, cylindrical, noodle-type flotation device. In an alternative embodiment, a squeeze-ball bladder pumping device in located within an end portion of an elongate personal flotation devise formed of resilient deformable material such that, when the end portion is squeezed, a stream of fluid is expelled through an orifice in a surface of the end portion. In another embodiment, the end portion is of a paddle tool shape and may be used to propel a flotation device user through the water in which the device is afloat.

20 Claims, 14 Drawing Sheets

PERSONAL FLOTATION DEVICE APPARATUS WITH HAND-HELD TOOL

This application is a continuation-in-part of application Ser. No. 08/840,207, filed Apr. 11, 1997, now U.S. Pat. No. 5,971,823.

TECHNICAL FIELD

The present invention relates to personal flotation devices. More particularly, the present invention relates to elongate, noodle-type flotation devices. Most particularly, the present invention relates to elongate, noodle-type flotation devices made of soft, elastic, buoyant foam materials and hand-held tools when used in an aquatic environment.

BACKGROUND OF THE INVENTION

Personal flotation devices which provide buoyant assistance to a person immersed in water in maintaining a portion of their body above the water's surface long have been known in the art. Such devices have been used for safety and rescue purposes as well as for recreation and amusement. These devices have taken various forms including life vests, water wings, small rafts, and toroidally shaped life preservers. Such devices may be fabricated utilizing rigid or soft buoyant materials and/or may include air filled chambers. A currently popular form of such device, used primarily for recreational purposes, is an elongate noodle-type device with free ends formed of soft, deformable, buoyant, plastic, closed-cell foam material. These devices may be placed between the legs, or across the chest and under the arms, or across the back and under the arms by a user to provide buoyant support and assistance. These personal floatation devices of the prior art have not generally been utilized to provide buoyant assistance when working with hand-held tools in an aquatic environment because of the difficulty of managing and controlling such flotation devices while utilizing an independent hand-held tool.

When used for recreation and amusement, these noodle-type personal flotation devices of the prior art are passive, generally offering only a buoyant force for flotation assistance and playful resistance.

Hand-held tools such as pump devices for projecting a stream of liquid toward distant locations have also long been known in the art. Such pump devices are commonly used to apply cleaners, water and other liquids to surfaces. Such pumps may also take the form of squeeze balls and water pistols utilized to project streams of water for amusement and recreation. These pumps to are typically associated with a reservoir of relatively small volume from which liquid is drawn and projected as a stream, spray, or mist.

DISCLOSURE OF THE INVENTION

It is an object of the present invention to provide buoyant assistance to an individual while utilizing a water pump, brush or other hand-held tool in an aquatic environment.

It is an additional object of the present invention to provide means for maintaining control and availability of a water pump, brush or other hand-held tool when the tool is being utilized in an aquatic environment.

It is a further object of the present invention to enhance the utility of noodle-type personal flotation devices in a swimming pool environment to assist in cleaning, watering, body misting, and other pool related activities performed with hand-held tools.

It is yet another object of the present invention to enhance the amusement and recreational value of noodle-type personal flotation devices.

It is a further object to increase mobility when using noodle-type personal flotation devices.

It is also an object of the present invention to provide a hand-held tool for use with a noodle-type personal flotation device in an aquatic environment.

In keeping with the above objectives, a noodle-type personal flotation device apparatus comprising a preferred embodiment of the present invention includes a tool head assembly with a mounting cup having a cylindrical wall and a flat base. The cup is sized to receive an end portion of an elongate, noodle-type personal flotation device of generally circular cross section in nested relation. The mounting cup wall may be provided with a hole to vent air and facilitate placement of the cup over the end portion of a flotation device. Once the mounting cup is placed over the end portion with the end of the flotation device abutting the cup base, a piece of adhesive tape may be placed over the hole. A boss extends outward from the mounting cup base, generally along the longitudinal axis of the flotation device. A tool head, including a handle and a trigger-operated, plunger-type hand pump for pumping water, is pivotally mounted on the boss such that it may rotate about the boss axis.

Preferably, the noodle-type personal flotation device is formed of a flexible, soft, closed-cell, plastic foam material, and a second water pumping device is mounted upon a second end of the flotation device. The flotation device is preferably of such a length that, when an intended user of the apparatus draws the personal flotation device across his back and under each of his arms so as to be supported upright in the water, the tool heads are at such a distance from the user that they each may be held comfortably in one of the users hands and the pumps activated.

In a second embodiment, a tool head including a brush with scrubbing bristles is mounted on each end of the noodle-type personal flotation device.

In another embodiment, propulsive tools, such as paddle and swim-fin type tools are provided to increase mobility of a noodle-type personal flotation device user.

Other objects, advantages and aspects of the invention will become apparent upon perusal of the following detailed description and claims and upon reference to the accompanying drawings.

DETAILED DESCRIPTION

Figure 1:
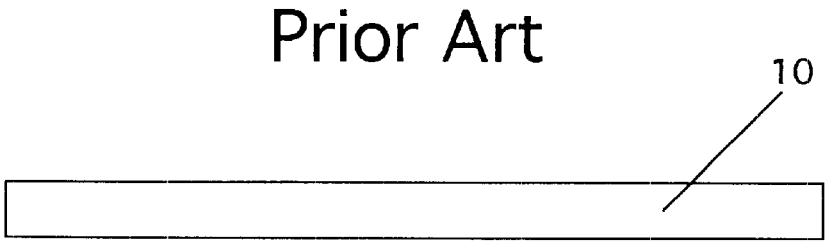
FIG. 1 is a side elevation of a noodle-type personal flotation device of the prior art.
Figure 2A:
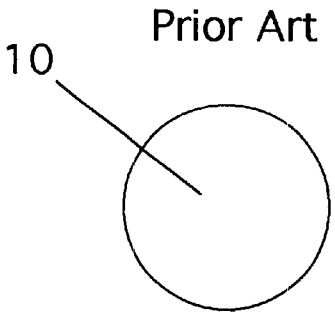
FIG. 2A is an end view of a noodle-type personal flotation device of the prior art having a circular cross section.
Figure 2B:
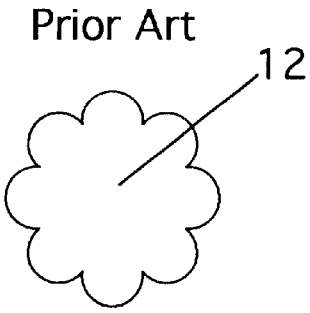
FIG. 2B is an end view of a noodle-type personal flotation device of the prior art having a a daisy-like cross section.
Figure 2C:
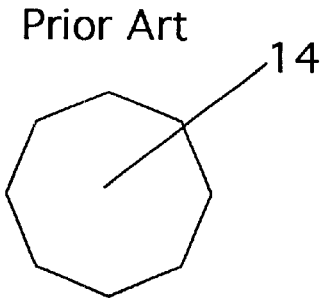
FIG. 2C is an end view of a noodle-type personal flotation device of the prior art having a polygonal cross section.

Noodle-type personal flotation device 10 of the prior art is shown in FIG. 1. Such noodle-type devices are commonly extruded of soft, deformable, buoyant, plastic, closed-cell plastic foam material. Typically, noodle-type personal flotation device 10 is of generally cylindrical form with a circular cross section, as seen in the end view of FIG. 2A, and has a diameter of about 2.5 to 4 inches. Noodle-type personal flotation devices may also have longitudinal surface relief from the outside diameter to provide a device with a scalloped, daisy-like cross section, as personal flotation device 12 of FIG. 2B, with a polygonal cross section, as personal flotation device 14 of FIG. 2C, or other geometric shapes.

Figure 3:
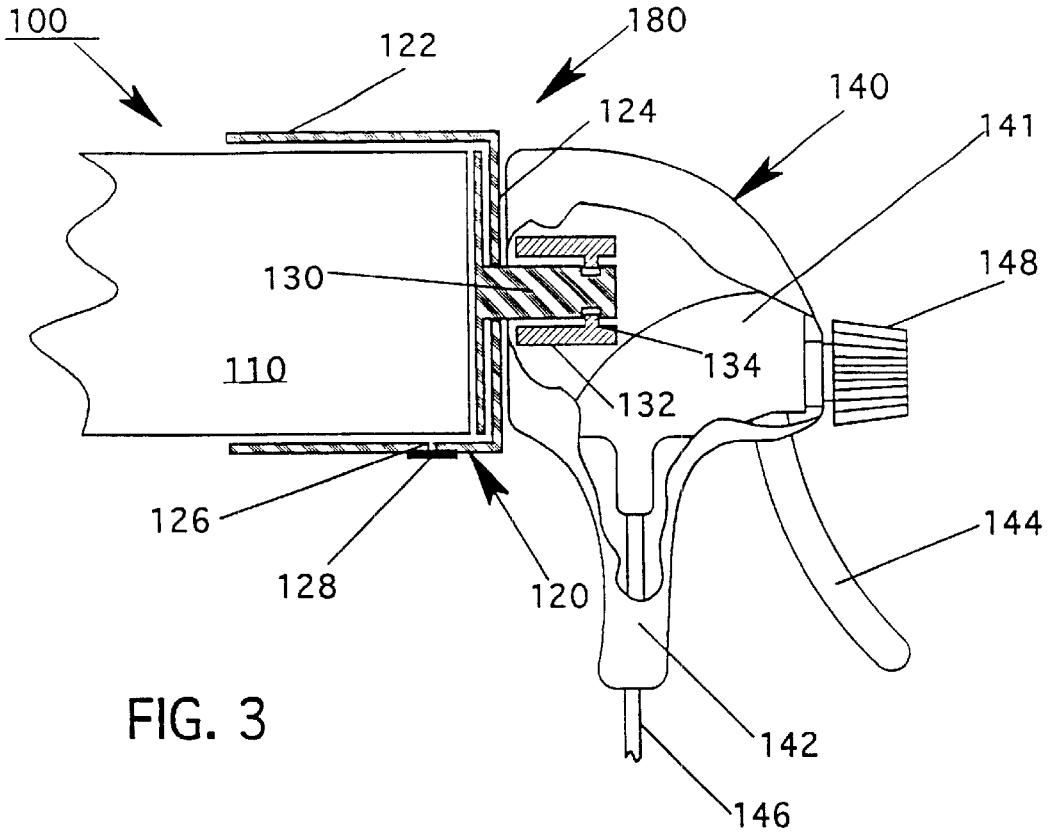
FIG. 3 is a side elevation, in partial section, of a noodle-type personal flotation device apparatus comprising a preferred embodiment of the present invention.

Exemplary noodle-type personal flotation device apparatus 100 comprising a preferred embodiment of the present invention is shown in the partial section view of FIG. 3. Tool head assembly 180 of exemplary noodle-type personal flotation device apparatus 100 comprises tool head 140 and mounting cup 120. Mounting cup 120 includes cylindrical mounting cup wall 122 and flat circular mounting cup base 124. The diameter of cylindrical wall 122 and circular base 124 is such that mounting cup 120 may nestingly receive an end portion of noodle-type personal flotation device 110. Vent hole 126 is provided in wall 122 to allow air to escape from mounting cup 120 as the end portion of noodle-type personal flotation device 110 is inserted into it. Once the end portion of noodle-type personal flotation device 110 is inserted in mounting cup 120, adhesive coated tape 128 may be placed over hole 126 to seal mounting cup 120 and allow suction to be created at the base of mounting cup 120 to assist in retaining the mounting cup on the end portion of noodle-type personal flotation device 110. Should it be desired to remove mounting cup 120 from noodle-type personal flotation device 110, tape 128 may be lifted and/or removed from hole 126 to facilitate removal. Mounting cup 120 is preferably made of plastic or other corrosion resistant material of sufficient rigidity to support tool head 140. Mounting cups may also be fabricated with scalloped or polygonal bases and walls of corresponding plan form, sized such that the cup wall continuously embraces the side wall of noodle-type personal flotation devices of scalloped or polygonal cross section, respectively, about their girths.

Figure 4:
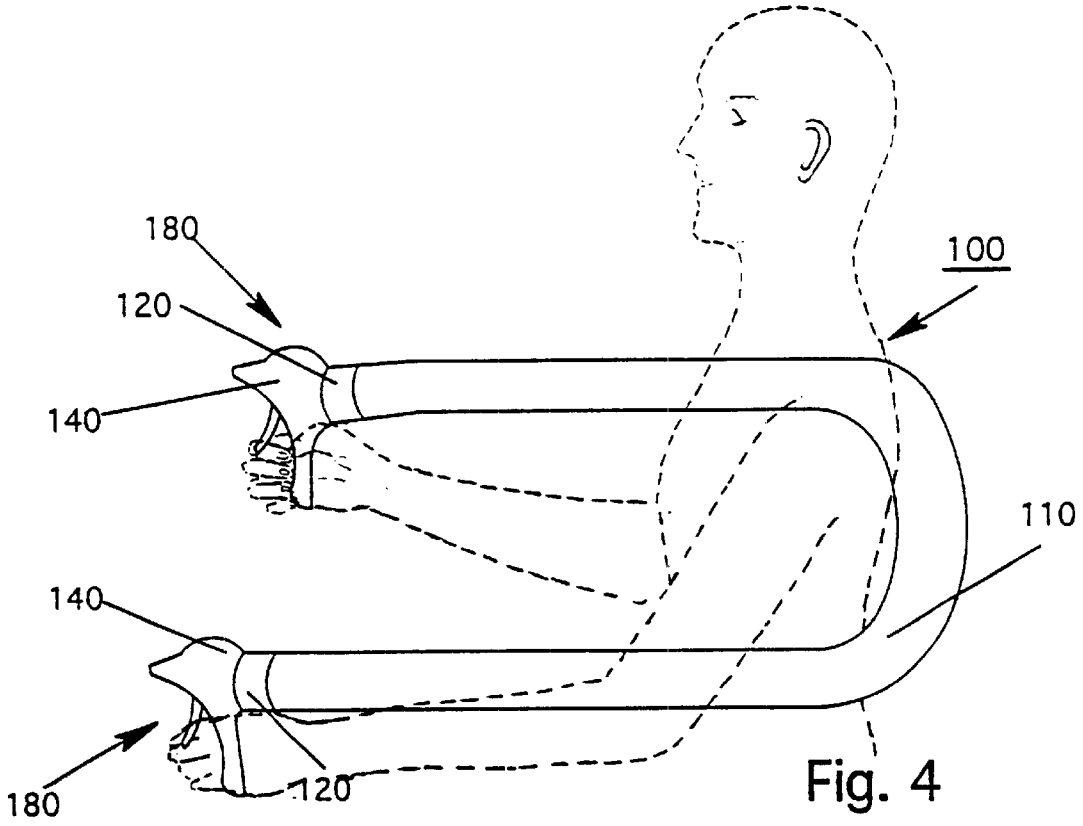
FIG. 4 is a pictorial view of a noodle-type personal flotation device apparatus comprising an embodiment of the present invention.

Tool head 140 of exemplary flotation apparatus 100 is attached to boss 130, which extends outwardly from base 124 of mounting cup 120 along an axis coinciding with a longitudinal axis of noodle-type personal flotation device 110. Bearing 132 and retention ridge 134 maintain tool head 140 in a fixed location along the longitudinal axis of boss 130 while allowing tool head 140 to rotate freelyabout the boss axis. Tool head 140 of exemplary noodle-type personal flotation device apparatus 100 includes fluid pumping tool 141 such as those well known in the art and commonly used for spraying, squirting and otherwise dispensing fluids from bottles and other fluid reservoirs. Fluid pumping tool 141 of tool head 140 is a piston type pumping apparatus, and liquids may be drawn into fluid source conduit 146 and projected as a spray or stream out of nozzle 148 by squeezing trigger 144 toward handle 142 of tool head 140. Liquids may be drawn from a reservoir into conduit 146, and the reservoir may be attached to or contained partially or entirely within handle 142. However, when exemplary noodle-type personal flotation device apparatus 100 is to be used for projecting water in an aquatic environment in which noodle-type personal flotation device apparatus 100 is afloat, conduit 146 may simply be allowed to extend downward into the water. For such applications, conduit 146 is preferably fabricated of soft plastic tubing and provided with a blunt end. Those familiar with the art will readily understand that tool head 140 may be made of a right and a left portion formed to embrace and retain boss 130 and pump tool 141 when placed about boss 130 and pump tool 141 and fastened together by screws, adhesive or other means Exemplary noodle-type personal flotation device apparatus 100 comprising the preferred embodiment of the present invention is shown in use in the pictorial view of FIG. 4. In flotation apparatus 100 of FIG. 4, a tool head assembly 180 comprising hand-held pumping tool head 140 and mounting cup 120 is attached to each end of noodle-type personal flotation device 110. Noodle-type personal flotation device 110 of the exemplary embodiment is of such a length that, when the flotation device is drawn across the back and under the arms of an intended user, hand-held pumping tool heads 140 are each correctly positioned for grasping by the left and right hand of the user, respectively. Exemplary noodle-type personal flotation device apparatus 100 may be used in a swimming pool environment to assist in cleaning, watering, body misting, and other pool related activities performed with hand held tools. Pumping tool head assemblies 180 also enhance the recreational and amusement value of noodle-type personal flotation device 110 in a pool environment.

Figure 5:
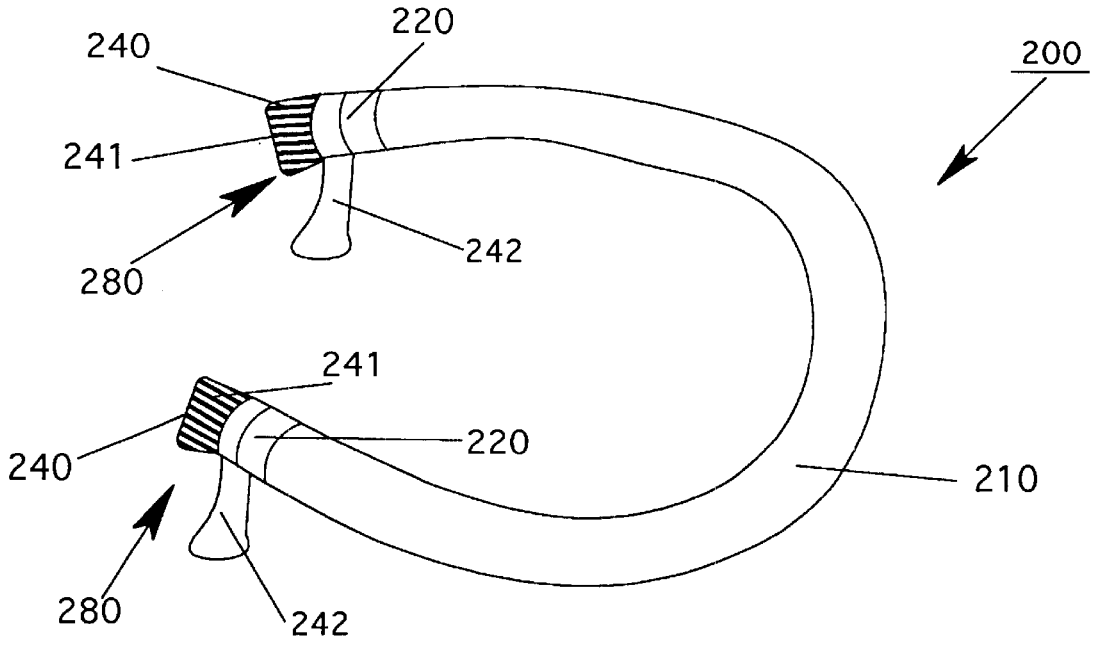
FIG. 5 is a pictorial view of a noodle-type personal flotation device apparatus comprising an alternative embodiment of the present invention.

An exemplary noodle-type personal flotation device apparatus 200 comprising an alternative embodiment of the present invention is shown in the pictorial view of FIG. 5 and includes tool-head assemblies 280. In the figures, similar elements are similarly numbered. In the apparatus of FIG. 5, tool head assemblies 280, each including a hand-held scrubbing tool, are attached to each end of noodle-type personal flotation device 210. Tool heads 240 of tool head assemblies 280 comprise scrubbing tool brush bristles 241 and handles 242. As in the embodiment of FIG. 4, noodle-type personal flotation device 210 is of such a length that, when the flotation device is drawn across the back and under the arms of an intended user, hand-held scrubbing tool heads 240 are correctly positioned for grasping by the left and right hand of the user. Noodle-type personal flotation device apparatus 200, may be used in cleaning activities in a pool or other aquatic environment, particularly for cleaning at or about waterlines.

It should be noted that hand held tool heads such as those of the exemplary embodiments comprising the present invention may include motors, with or without energy sources, to assist in tool functions. For example, tool head 240 may include a motor to rotate bristles 241 to assist in scrubbing. Also, hand held tools included in noodle-type personal flotation device apparatus comprising the present invention and utilized in an aquatic environment may be heavier and more massive than those otherwise used in a hand held manner because of the reduction of effort required to hold and operate the tools with buoyant relief.

Figure 6:
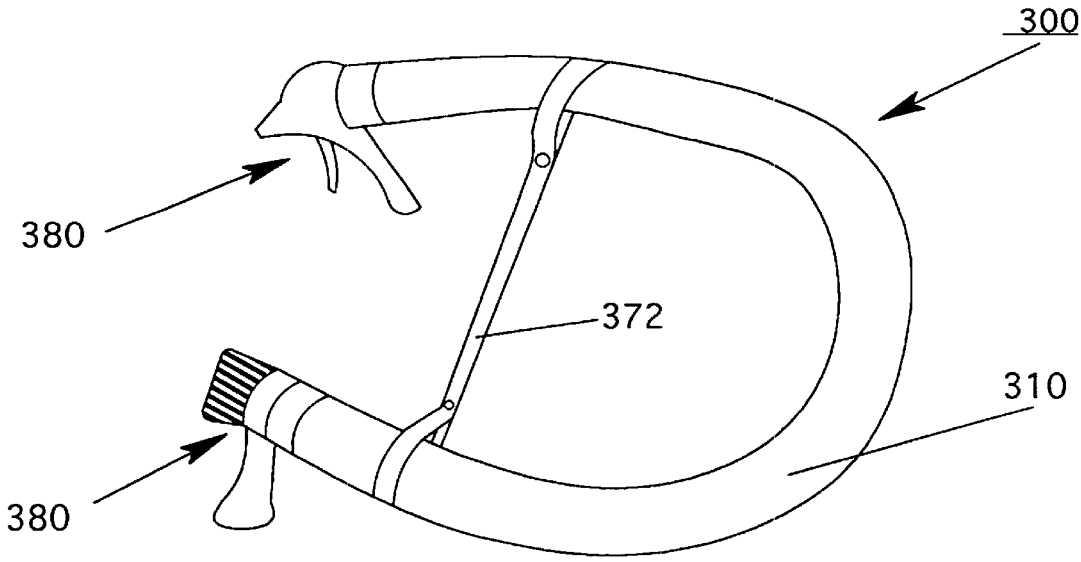
FIG. 6 is a pictorial view of a noodle-type personal flotation device apparatus comprising an alternative embodiment of the present invention.

Yet another noodle-type personal flotation device apparatus 300 comprising an alternative embodiment of the present invention includes hand-held pumping tool head assembly 380 on one end and hand held scrubbing tool head assembly 380 on the other end, as shown in the pictorial view of FIG. 6. This apparatus may be particularly useful when cleaning pools at or near the waterline. A liquid reservoir may be utilized with the pumping tools of the embodiment of FIG. 6 to apply liquids other than water, such as cleaning solutions, in scrubbing operations. Also, as shown in FIG. 6, strap 372 may be provided to assist in maintaining the personal flotation device in a roughly "U" shaped configuration.

Figure 7:
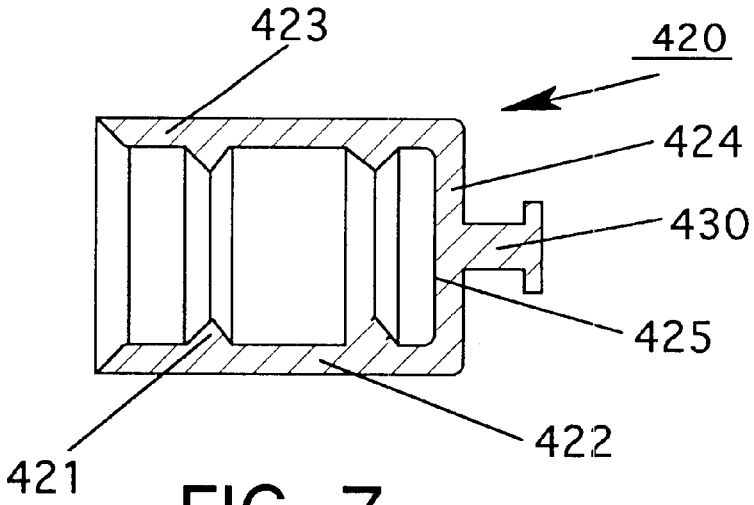
FIG. 7 is a sectional side view of a mounting cup of a noodle-type personal flotation device apparatus comprising an alternative embodiment of the present invention.

Various means may be used to enhance retention forces maintaining a mounting cup in position on an end portion of a noodle-type personal flotation device. Mounting cup 420 of an alternative embodiment of the present invention is shown in the section view of FIG. 7. In the embodiment of FIG. 7, an adhesive is applied to inner surface 423 of cylindrical wall 422 and inner surface 425 of base 424 before an end portion of a noodle-type personal flotation device is inserted m mounting cup 420. As with earlier described embodiments, a hole, or a plurality of holes may be formed in mounting cup 424 to allow air to escape when it is pressed over the end of a noodle-type personal flotation device. Wall 422 and base 424 may also include holes to reduce weight and the amount of material required to fabricate the mounting cup. Further, friction enhancing ridges 421 may be formed on the inner surface 423 of wall 422.

Figure 8:
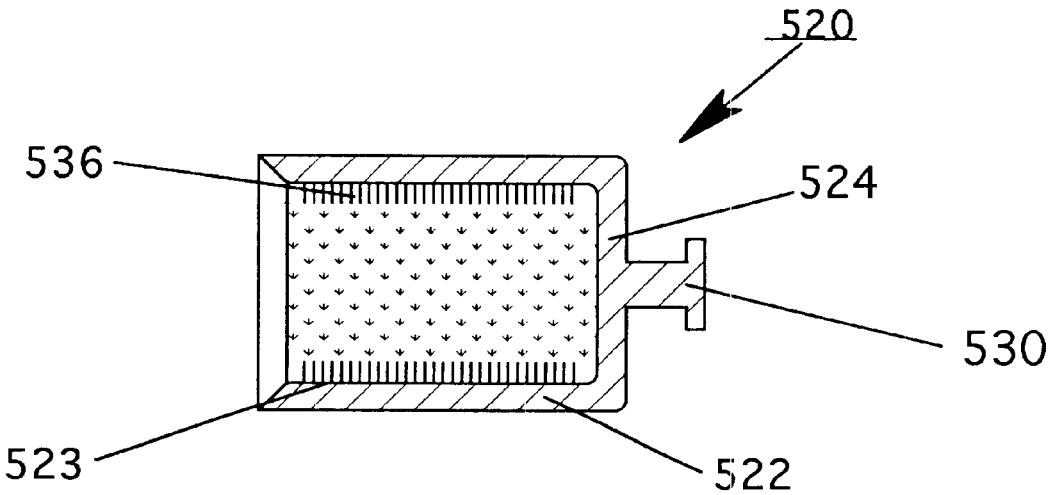
FIG. 8 is a sectional side view of a mounting cup of a noodle-type personal flotation device apparatus comprising an alternative embodiment of the present invention.

Mounting cup 520 of a noodle-type personal flotation device apparatus comprising an alternative embodiment of the present invention is shown in the section view of FIG. 8. Flexible bristles 536 are provided on interior surface 523 of cylindrical wall 522 of mounting cup 520. Once mounting cup 520 is pressed over an end portion of a noodle-type personal flotation device, bristles 536 tend to pierce the surface of the noodle in response to forces pulling outward on mounting cup 520 and enhance retentive forces.

Figure 9:
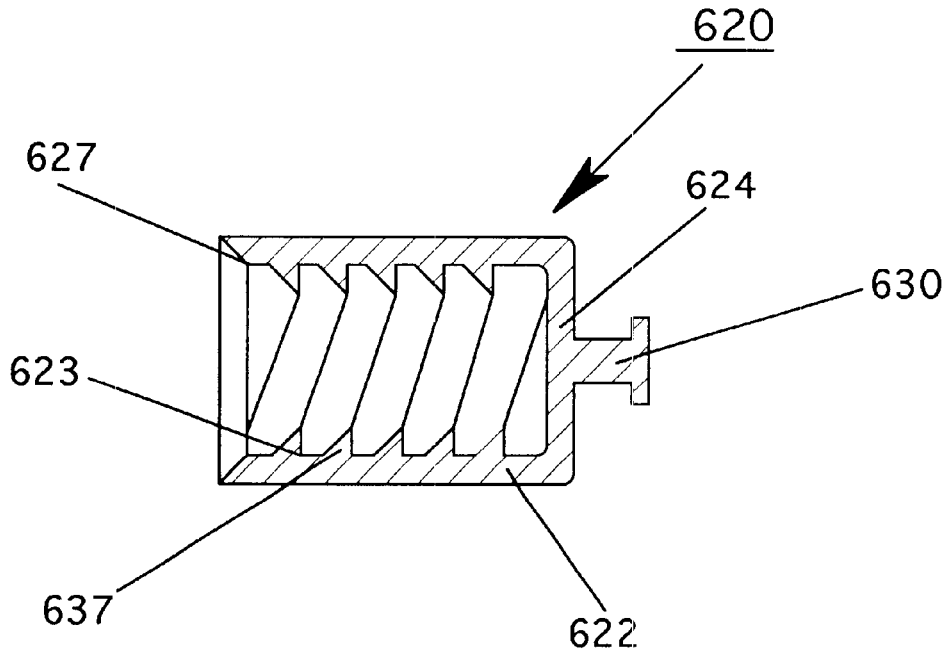
FIG. 9 is a sectional side view of a mounting cup of a noodle-type personal flotation device apparatus comprising an alternative embodiment of the present invention.

In mounting cup 620 of a noodle-type personal flotation device apparatus comprising another alternative embodiment of the present invention, shown in the section view of FIG. 9, screw threads 637 are formed on interior surface 623 of cylindrical wall 622 to enhance retention forces after mounting cup 620 is screwed over an end portion of a noodle-type personal flotation device. Internal threads 637 of mounting cup 620 may be of the nature of pipe threads, tapering from a larger internal diameter at outer edge 627 of mounting cup 620, inward, to a smaller diameter, adjacent base 624 such that the material of which the end portion of a noodle-type personal flotation device upon which end cup 620 is screwed is compressed and presses outward upon cylindrical wall 622 adjacent base 624 to further enhance retentive force.

Figure 10:
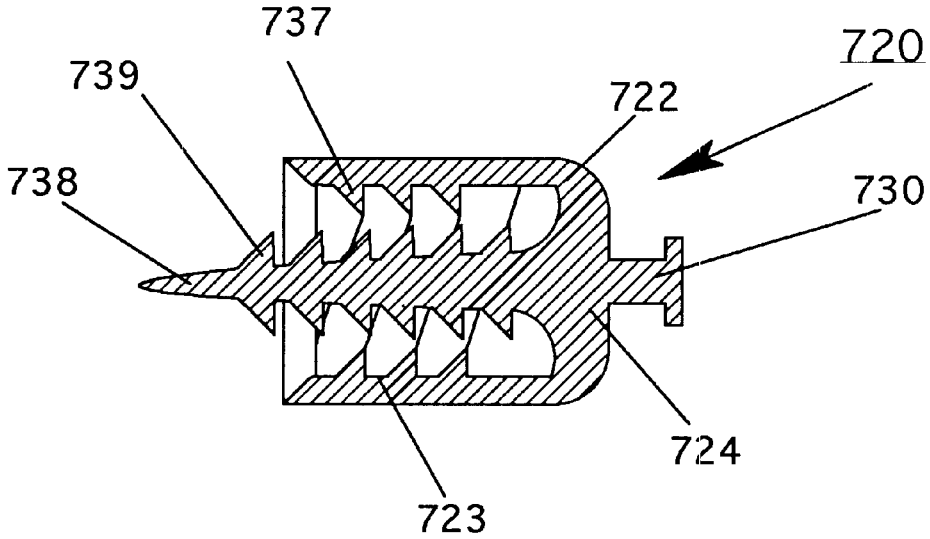
FIG. 10 is a sectional side view of a mounting cup of a noodle-type personal flotation device apparatus comprising an alternative embodiment of the present invention.

Mounting cup 720 of a noodle-type personal flotation device apparatus comprising another alternative embodiment of the present invention is shown in the partial sectional view of FIG. 10. In that embodiment, internal surface 723 of cylindrical wall 722 of mounting cup 720 includes internal screw threads 737. Mounting cup 720 further includes tapered boss 738 extending inward from base 724 and having an exterior surface including external screw threads 739. When mounting cup 720 is threaded into and around an end portion of a noodle-type personal flotation device, tapered boss 738 forces material of which the end portion of the noodle-type personal flotation device is fabricated outward, compressing it between external threads 739 and internal threads 737 to enhance retention of mounting cup 720.

Figure 11:
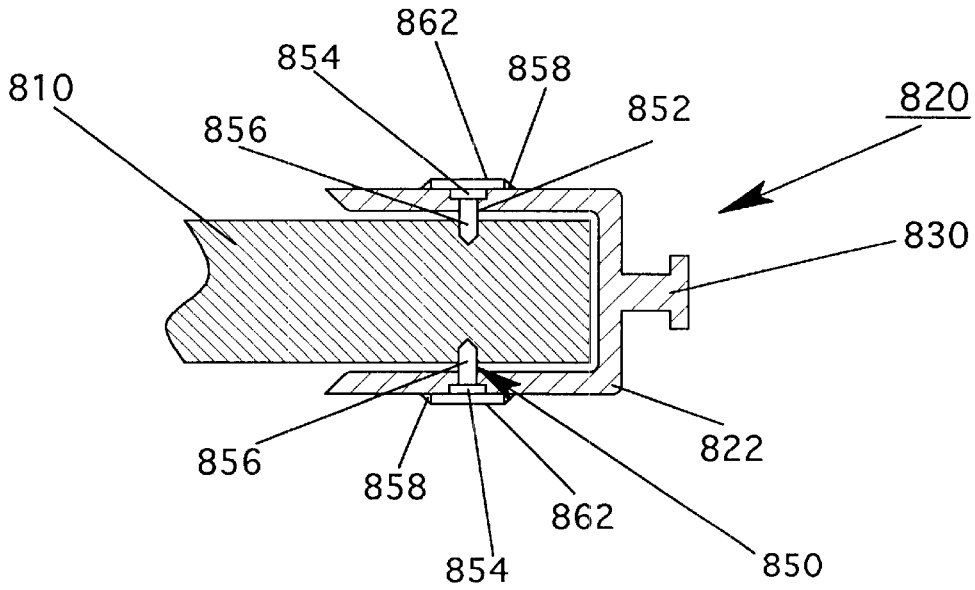
FIG. 11 is a sectional side view of a mounting cup of a noodle-type personal flotation device apparatus comprising an alternative embodiment of the present invention.

Mounting cup 820 of a noodle-type personal flotation device apparatus comprising another alternative embodiment of the present invention is shown in sectional view of FIG. 11. Shaft 856 of pin 850 passes through hole 852 in cylindrical wall 822 and into the interior of noodle-type personal flotation device 810. Elastic retention ring 862 is then slid over mounting cup 820 to a position between locating ridges 858 to retain head 854 of pin 850 against wall 822 of mounting cup 820.

Figure 12:
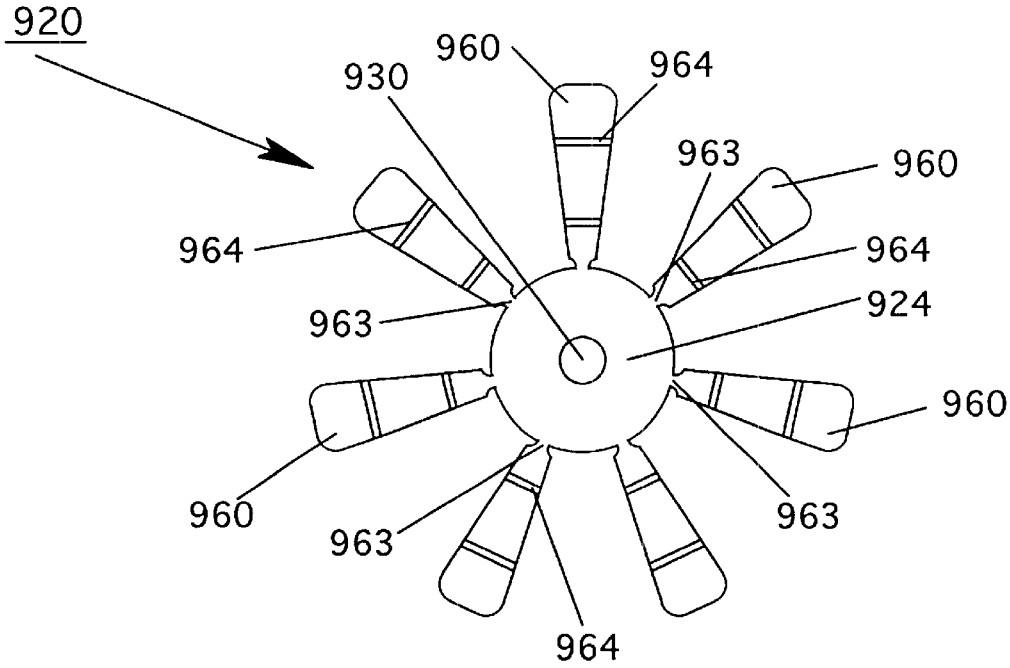
FIG. 12 is a plan view of a mounting cup component of a noodle-type personal flotation device apparatus comprising an alternative embodiment of the present invention.
Figure 13:
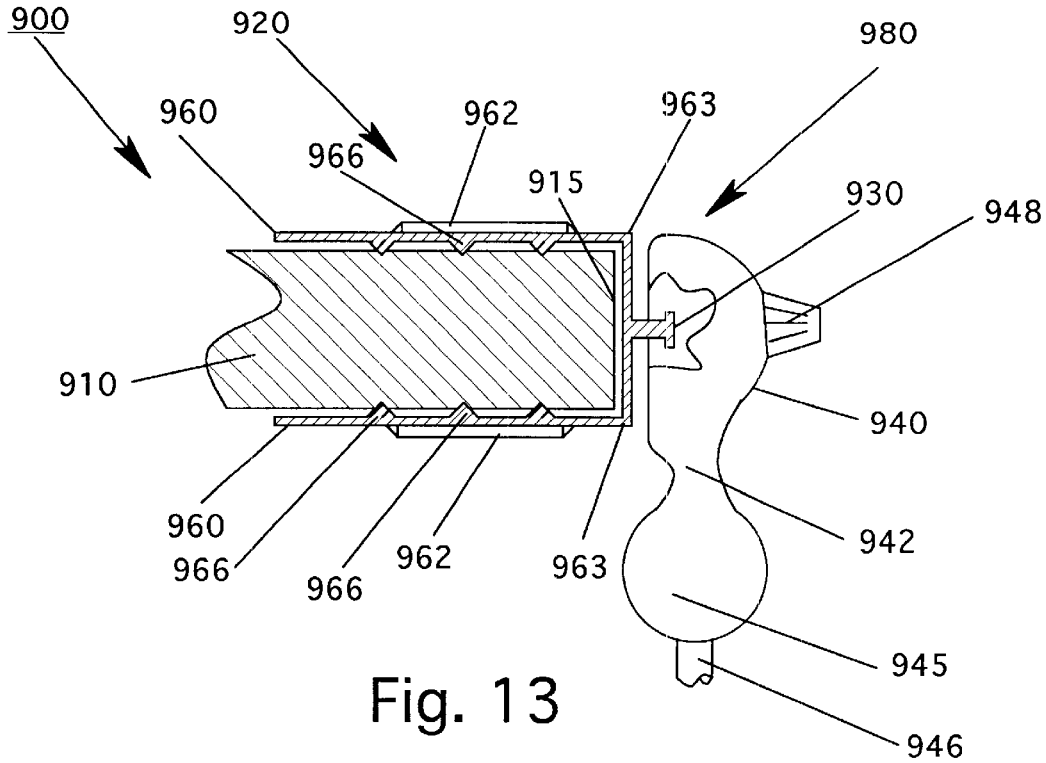
FIG. 13 is a side elevation, in partial section, of a portion of a noodle-type personal flotation device apparatus comprising an alternative embodiment of the present invention.

Mounting cup 920 of tool head assembly 980 of noodle-type personal flotation device apparatus 900 comprising another alternative embodiment of the present invention is shown flat in the plan view of FIG. 12, and shown mounted on noodle-type personal flotation device 910 in the partial section view of FIG. 13. When flat, fingers 960 are attached to the edge of base 924 at base ends 963 and extend outward from mounting cup base 924. Base 924, fingers 960 and boss 930 are preferably made of a flexible plastic material sufficiently strong to support hand held tool head 940. For attachment to an end portion of noodle-type personal flotation device 910, base 924 of mounting cup 920 is placed in abutment with flotation device end face 915 and fingers 960 are folded along the side of the end portion of flotation device 910. Compressing ring 962 is then pressed over the base ends 961 of fingers 960 and the end portion of noodle-type personal flotation device 910 toward the distal ends of fingers 960. This presses fingers 960 inward about the end portion of flotation device 910, clamping the end portion of flotation device 910 between the fingers. Compressing ring 962 may be made of a relatively ridged material, such as plastic, or a very elastic material such rubber. Location ridges 964 may be provided in the exterior surface of the fingers to assist in maintaining compressing ring 962 in place. As in the case of previously described embodiments, the interior surfaces of fingers 960 may be provided with friction enhancements such as application of adhesive to the inner surface of the fingers 960, texturing of the interior surface of fingers 960, or ridges 966 formed in the interior surface of fingers 960. For use with noodle-type personal flotation devices having polygonal or scalloped cross sections, the base of the mounting cup maybe made of such size and shape that the fingers lie along the flotation devices longitudinal relieved wall portions. The water pump of tool head 940 of tool head assembly 980 of the embodiment of FIG. 13 is a squeeze ball pump, well known to those of the art, which is actuated by squeezing ball portion 945 of handle 942.

Figure 14:
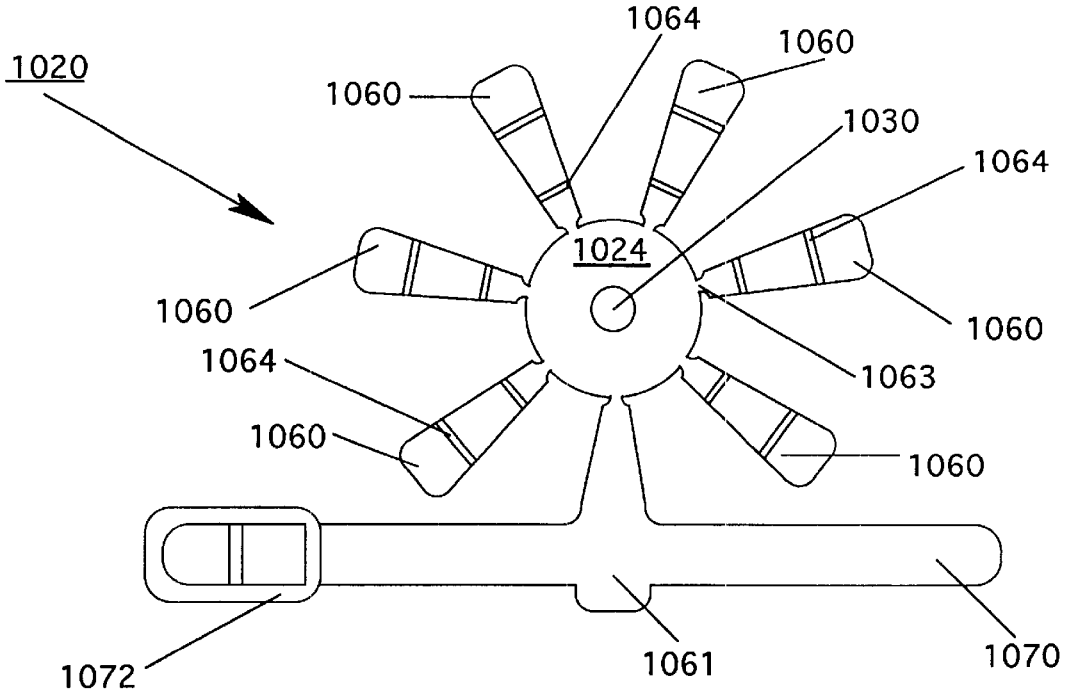
FIG. 14 is a plan view of a mounting cup component of a noodle-type personal flotation device apparatus comprising an alternative embodiment of the present invention.
Figure 15:
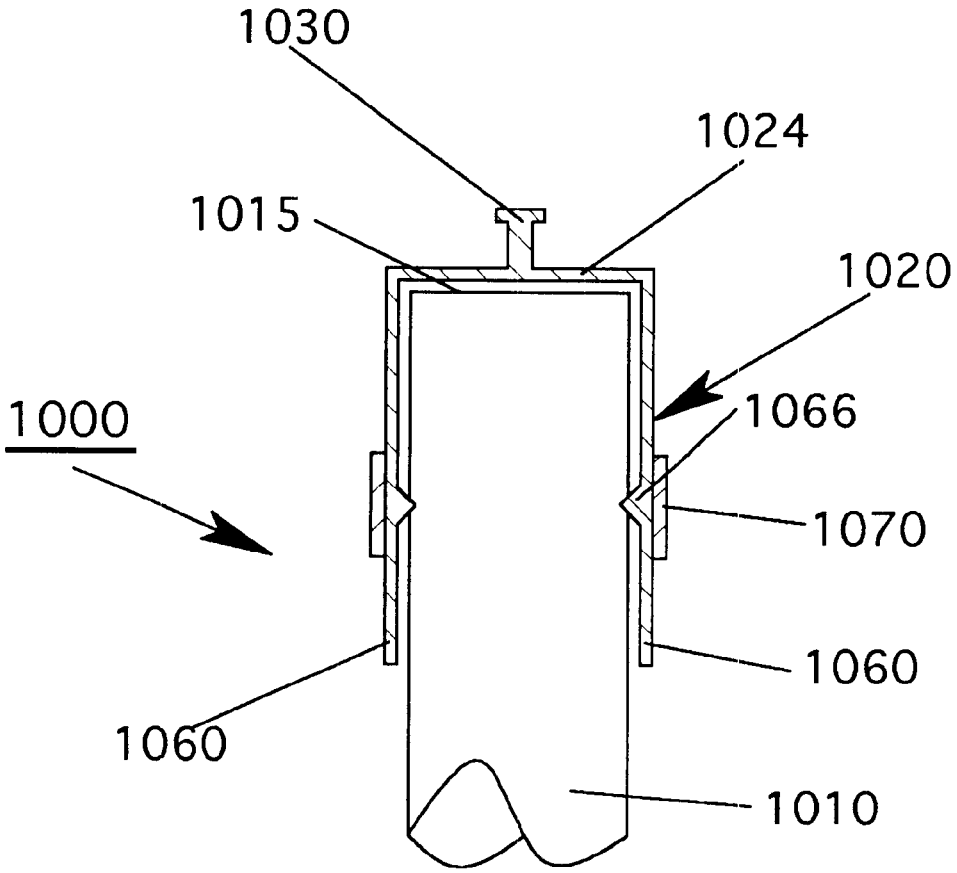
FIG. 15 is a plan view, in partial section, of a portion of a noodle-type personal flotation device apparatus comprising an alternative embodiment of the present invention.

Mounting cup 1020 of a noodle-type personal flotation device apparatus comprising another alternative embodiment of the present invention is shown flat in the plan view of FIG. 14 and mounted on noodle-type personal flotation device 1010 in the partial section view of FIG. 15. Mounting cup 1020 includes fingers 1060 extending from base 1024. Compression strap 1070 is formed integral with finger 1061, and has ends extending from opposite sides of finger 1061 generally along a strap axis normal to the longitudinal axis of finger 1061. For attachment to an end portion of noodle-type personal flotation device 1010, base 1024 of mounting cup 1020 is placed in abutment with flotation device end face 1015 and fingers 1060 and finger 1061 are folded along the side of the end portion of flotation device 1010. Compressing strap 1070 is then wrapped about fingers 1060 and the end portion of noodle-type personal flotation device 1010. The ends of compressing strap 1070 are then drawn together and fastened with fastener 1072 clamping the end portion of flotation device 1010 between the fingers 1060 and 1061. Fastener 1072 may be any of many fasteners well known in the art, including buckle type and tie type fasteners. Friction enhancement features may be provided on the interior surfaces of fingers 1060 and 1061.

Figure 16A:
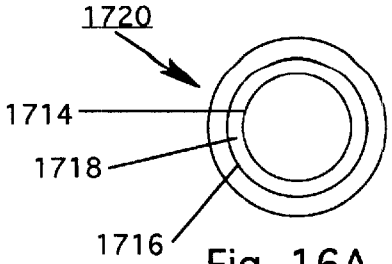
FIG. 16A is an end view of a mounting cup of a noodle-type personal flotation device apparatus comprising an alternative embodiment of the present invention.
Figure 16B:
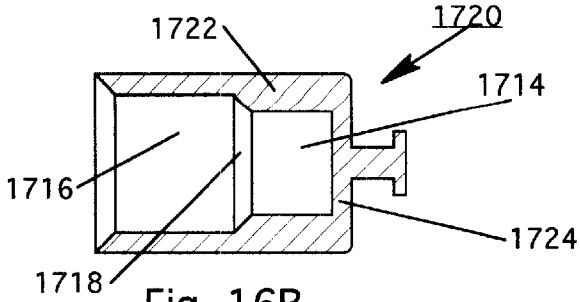
FIG. 16B is a sectional side view of a mounting cup of a noodle-type personal flotation device apparatus comprising an alternative embodiment of the present invention.

Mounting cup 1720 of a noodle-type personal flotation device apparatus comprising another alternative embodiment of the present invention is shown in the end view of FIG. 16A and sectional view of FIG. 16B. Mounting cup 1720 includes outer cylindrical interior surface 1716 and inner interior surface 1714 which is also cylindrical but of smaller diameter than outer interior surface 1716. Inner surface 1718 is a conical transitional surface between outer interior surface 1720 and inner interior surface 1716. This configuration allows mounting cup 1720 to be used with circular cross section noodle-type flotation devices of two distinct diameters. End portions of the larger diameter devices are inserted into cup 1720 until the outside edge of the flotation device body end face is firmly seated against transition surface 1718. The end portions of smaller diameter flotation devices are inserted until the flotation device body end face is firmly seated against the interior surface of cup base 1724.

Figure 17A:
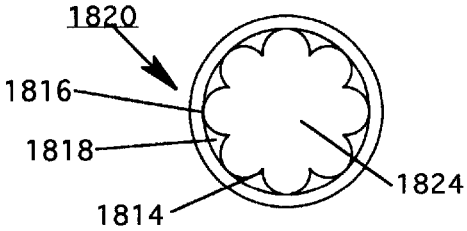
FIG. 17A is an end view of a mounting cup of a noodle-type personal flotation device apparatus comprising an alternative embodiment of the present invention.
Figure 17B:
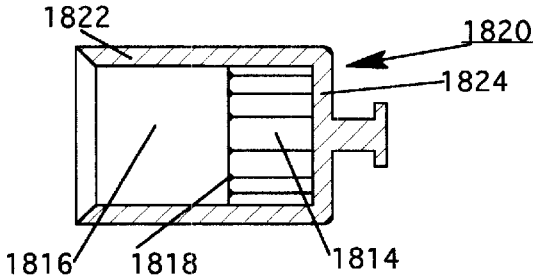
FIG. 17B is a sectional side view of a mounting cup of a noodle-type personal flotation device apparatus comprising an alternative embodiment of the present invention.

Mounting cup 1820 of a noodle-type personal flotation device apparatus comprising another alternative embodiment of the present invention is shown in the end view of FIG. 17A and sectional view of FIG. 17B. Mounting cup 1820 includes outer cylindrical interior surface 1816 and inner interior surface 1814 which is of a daisy-type cross section. Inner surfaces 1818 are transitional surfaces between outer interior surface 1820 and inner interior surface 1816. This configuration allows mounting cup 1820 to be used with noodle-type flotation devices of both circular and daisy-type cross section. End portions of circular cross section devices are inserted into cup 1820 until the outside edge of the flotation device body end face is firmly seated against transition surfaces 1818. The end portions of daisy-type cross section flotation devices are inserted until the flotation device body end face is firmly seated against the interior surface of cup base 1824.

Figure 18A:
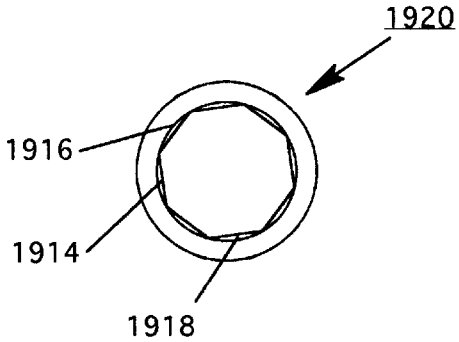
FIG. 18A is an end view of a mounting cup of a noodle-type personal flotation device apparatus comprising an alternative embodiment of the present invention.
Figure 18B:
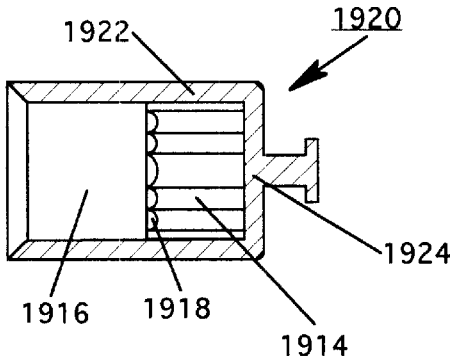
FIG. 18B is a sectional side view of a mounting cup of a noodle-type personal flotation device apparatus comprising an alternative embodiment of the present invention.

Mounting cup 1920 of a noodle-type personal flotation device apparatus comprising another alternative embodiment of the present invention is shown in the end view of FIG. 18A and sectional view of FIG. 18B. Mounting cup 1920 includes outer cylindrical interior surface 1916 and inner interior surface 1914 which is of a polygon-type cross section. Inner surfaces 1918 are transitional surfaces between outer interior surface 1920 and inner interior surface 1916. This configuration allows mounting cup 1920 to be used with noodle-type flotation devices of both circular and polygon-type cross section. End portions of circular cross section devices are inserted into cup 1920 until the outside edge of the flotation device body end face is firmly seated against transition surfaces 1918. The end portions of polygon-type cross section flotation devices are inserted until the flotation device body end face is firmly seated against the interior surface of cup base 1924.

Figure 19:
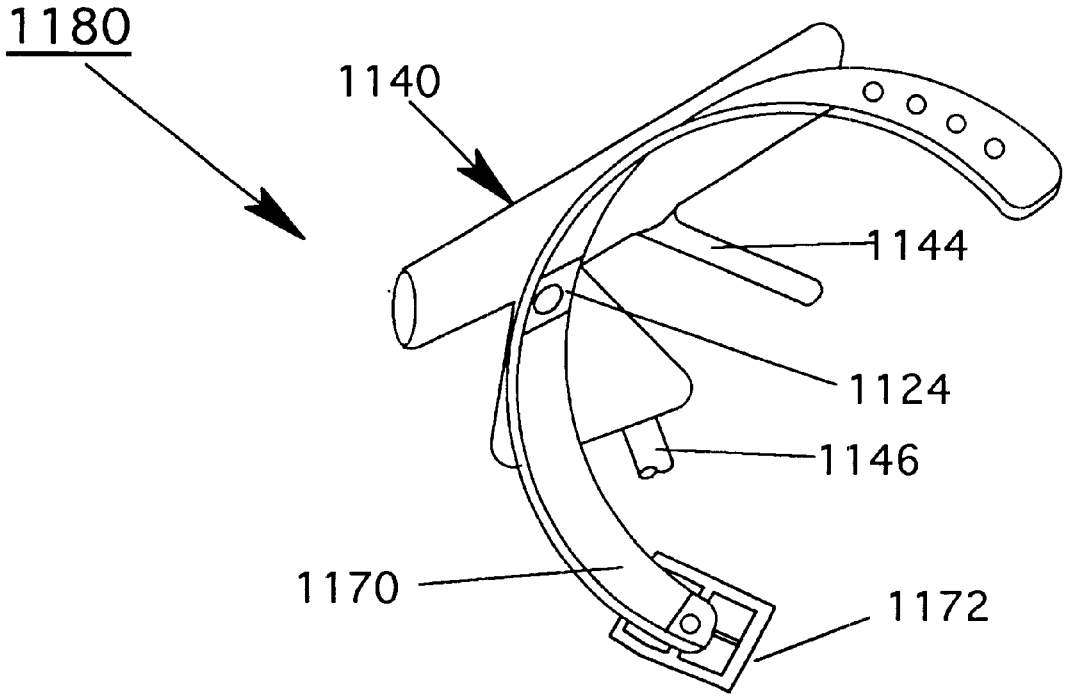
FIG. 19 is a pictorial view of a tool head and strap of a noodle-type personal flotation device apparatus comprising an alternative embodiment of the present invention.

Hand-held tool head assembly 1180 of a noodle-type personal flotation device apparatus comprising another alternative embodiment of the present invention is shown in the isometric pictorial view of FIG. 19 and includes tool head 1140 mounted upon mounting base 1124. Strap 1170 extends from mounting base 1124. When mounted on a noodle-type personal flotation device, strap 1170 is wrapped about an end portion of the noodle-type personal flotation device with its ends fastened by fastener 1172.

Figure 20:
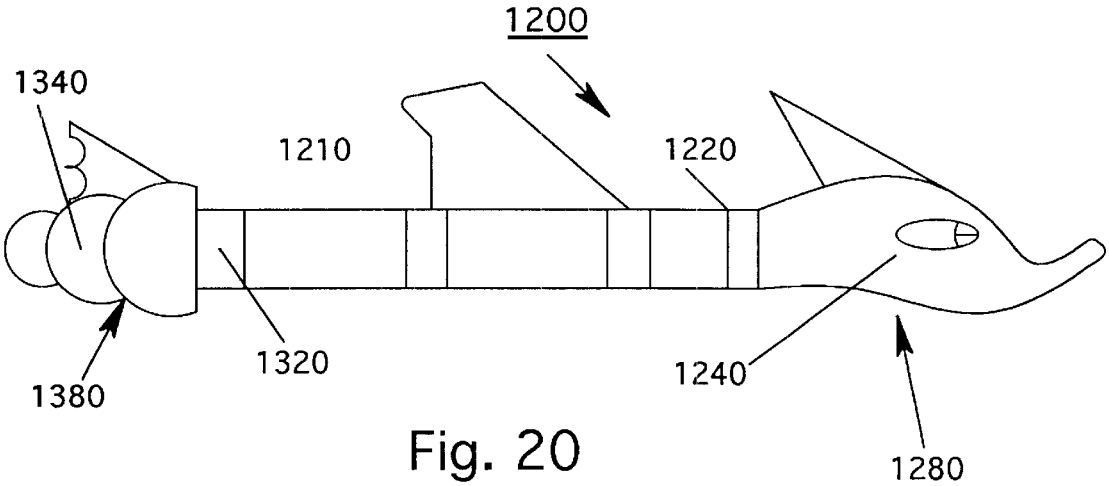
FIG. 20 is a side elevation of a noodle-type personal flotation device apparatus comprising an alternative embodiment of the present invention.

A noodle-type personal flotation device apparatus comprising another alternative embodiment of the present invention is shown in the elevation of FIG. 20. Hand-held tool head 1240 of tool head assembly 1280 of personal flotation device apparatus 1200 includes a squeeze-ball type water pumping device in the ornamental form of a serpent head and is mounted on noodle-type personal flotation device by mounting cup 1220. A second tool-head assembly 1380, including mounting cup 1320 and tool-head 1340 having an ornamental serpent-tail handle is mounted on the other end of noodle-type personal flotation device 1310 to complete noodle-type personal flotation device apparatus 1200 with a hand-held squirting tool and serpent-like appearance.

Figure 21:
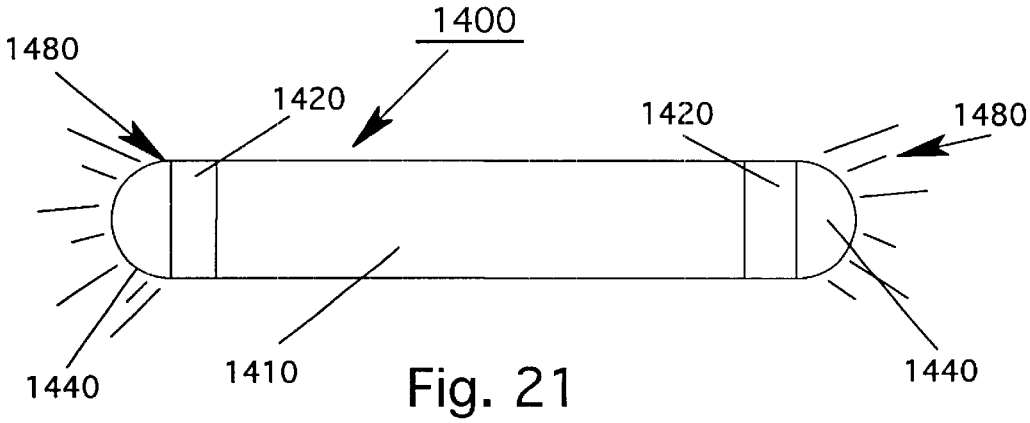
FIG. 21 is a side elevation view of a noodle-type personal flotation device apparatus comprising an alternative embodiment of the present invention.

A noodle-type personal flotation device apparatus comprising another alternative embodiment of the present invention is shown in FIG. 21. In that embodiment, tool head assemblies 1480 with light emitting hand-held tool heads 1440 are mounted on two ends of noodle-type personal flotation device 1410 by mounting cups 1420 to provide exemplary light emitting noodle-type personal flotation device apparatus 1400.

Figure 22:
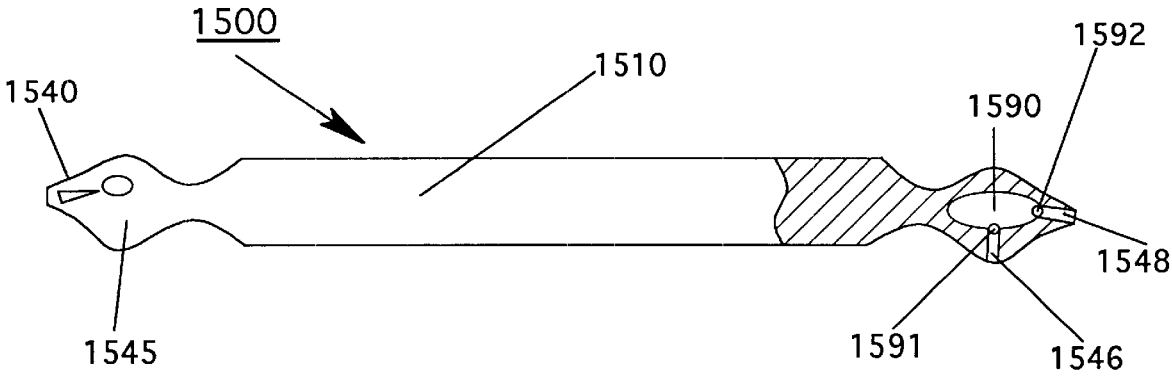
FIG. 22 is a side elevation, in partial section, of a noodle-type personal flotation device apparatus comprising an alternative embodiment of the present invention.

Noodle-type personal flotation device apparatus comprising another alternative embodiment of the present invention shown in partial section elevation in FIG. 22. Hand-held tool heads 1540 of personal flotation device apparatus 1500 each include a squeeze-ball bladder type fluid pumping device. Hand-held tool heads 1540 are of an ornamental form of serpent heads and are formed integrally with end portions of flotation device 1510. Each hand-held tool head 1540 includes a resilient squeeze-ball bladder 1590, intake conduit 1546, upstream check valve 1591, downstream check valve 1592 and nozzle passage 1548. Those familiar with the art will understand that fluid may be pumped by squeezing the serpent head and, consequently, the resilient squeeze-ball bladder.

When the squeeze-ball bladder is squeezed, check valve 1591 prevents water from being expelled through conduit 1546 while check valve 1592 allows water to flow through nozzle passage 1548. As the resilient squeeze-ball bladder expands, check valve 1592 prevents water from being drawn into the squeeze-ball bladder through nozzle passage 1548 while check valve 1591 allows water to be drawn in through conduit 1546. When the squeeze-ball bladder is again squeezed, water is again forced to flow through nozzle passage 1548.

Figure 23:
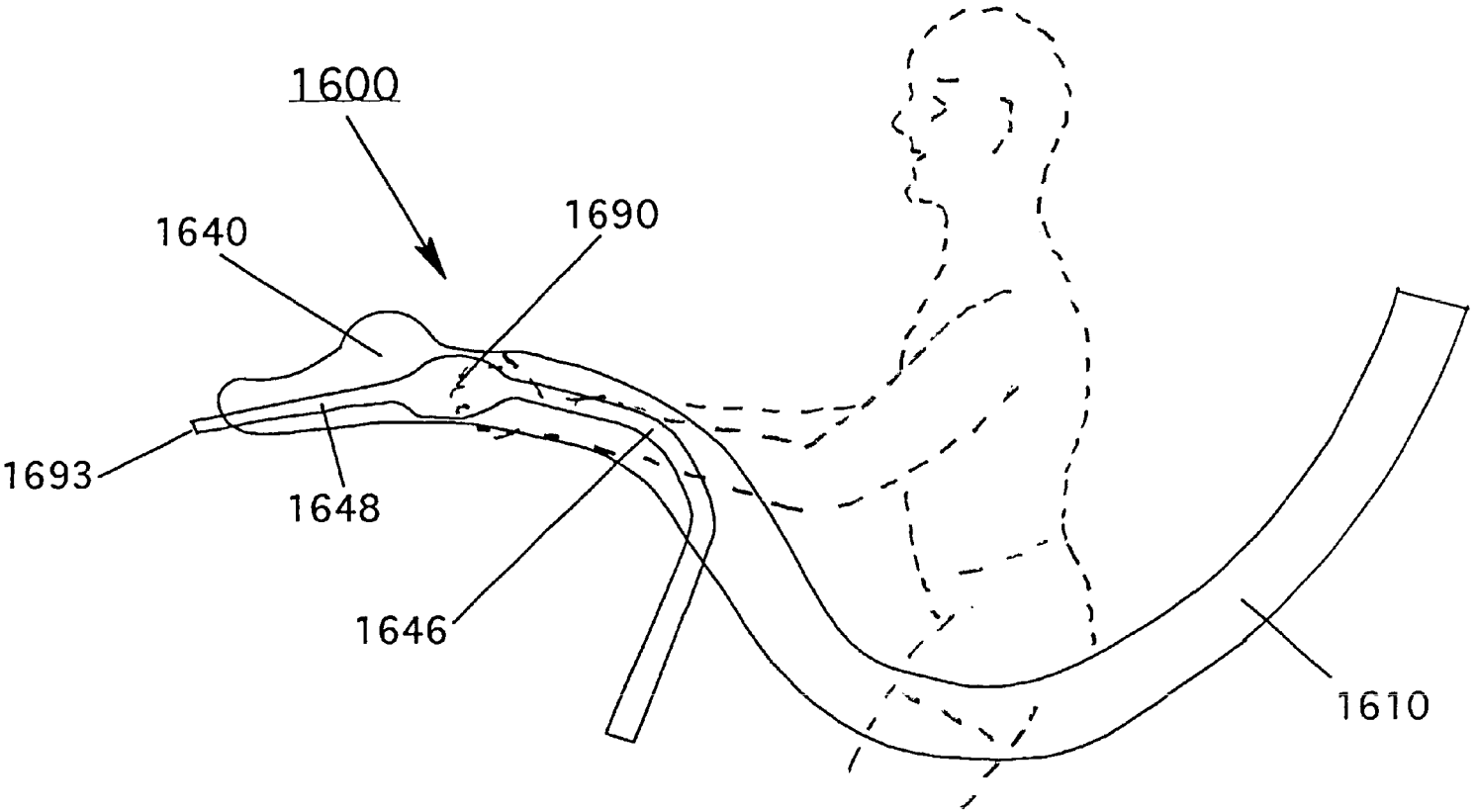
FIG. 23 is a side elevation, in partial section, of a noodle-type personal flotation device apparatus comprising an alternative embodiment of the present invention.

Noodle-type personal flotation device apparatus comprising another alternative embodiment of the present invention shown in partial section elevation in FIG. 23. Hand-held tool head 1640 of personal flotation device apparatus 1600 includes squeeze-ball bladder type fluid pumping device 1690. Hand-held tool head 1640 is of the ornamental form of serpent head and is formed integrally with an end portion of flotation device 1610. In this embodiment, nozzle tube 1648 extends beyond the surface of end portion 1640 to form protruding nozzle 1693.

Figure 24:
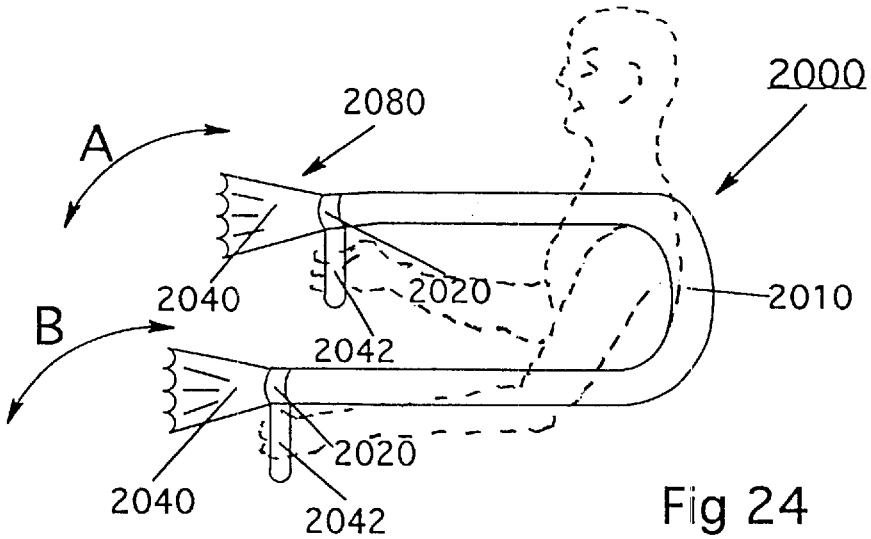
FIG. 24 is a pictorial view of a noodle-type personal flotation device apparatus comprising an alternative embodiment of the present invention.

An exemplary noodle-type flotation device apparatus 2000 comprising an alternative embodiment of the present invention is shown in use in the pictorial view of FIG. 24. In flotation apparatus 2000 of FIG. 24, a tool head assembly 2080 comprising hand-held water propulsion tool 2040 and mounting cup 2020 is attached to each end of noodle-type personal flotation device 2010. Tool heads 2080 include handles 2042 to assist in working swim-fin propulsion tools 2040. Noodle-type personal flotation device 2010 is of such a length that, when the flotation device is drawn across the back and under the arms of an intended user, handles 2042 of propulsion tool heads 2080 are each correctly positioned for grasping by the left and right hand of the user, respectively. Water propulsion tools 2040 of tool heads 2080 are flexible swim-fin type propulsion tools which allow a user of the noodle-type personal floatation apparatus to propel himself backward in a desired direction by selectively moving tool heads 2080 back and forth in the water in a generally horizontal plane as indicated by arrows A and B. While, in this embodiment, tool heads 2080 include handles 2042 to assist in working swim-fin propulsion tools 2040, propulsion tool heads 2080 might also be worked by grasping mounting cups 2020 or the end portions of flotation device 2010 in immediate proximity to mounting cups 2020. Propulsion tool head assemblies 2080 enhance the recreational and amusement value of noodle-type personal flotation device 2010 in a pool environment.

Figure 25:
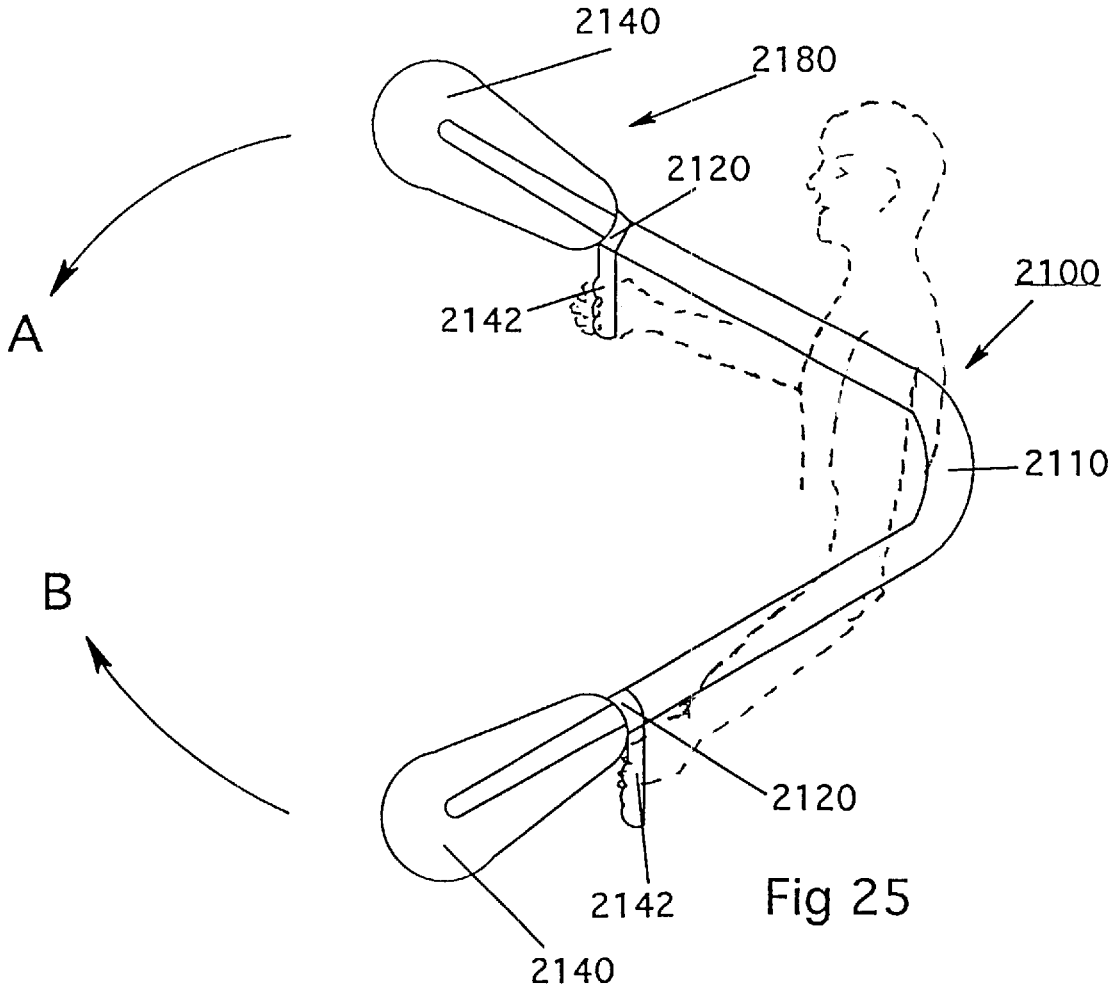
FIG. 25 is a pictorial view of a noodle-type personal flotation device apparatus comprising an alternative embodiment of the present invention.
Figure 26C:
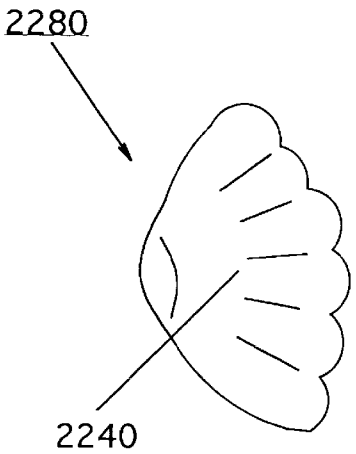
FIG. 26C is an end view of a tool head of a noodle-type personal flotation device comprising an alternative embodiment of the present invention and including a shell shaped paddle tool.
Figure 26B:
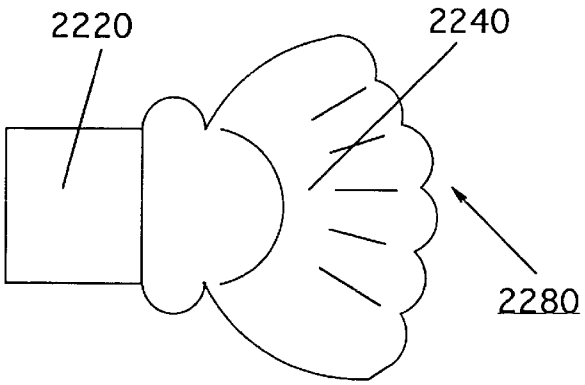
FIG. 26B is a plan view of a tool head of a noodle-type personal flotation device comprising an alternative embodiment of the present invention and including a shell shaped paddle tool.
Figure 26A:
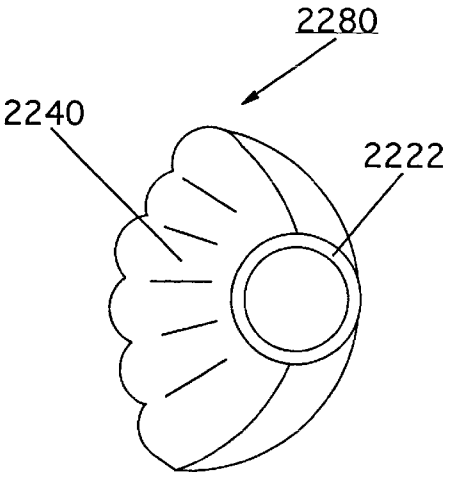
FIG. 26A is an end view of a tool head of a noodle-type personal flotation device comprising an alternative embodiment of the present invention and including a shell shaped paddle tool.
Figure 26D:
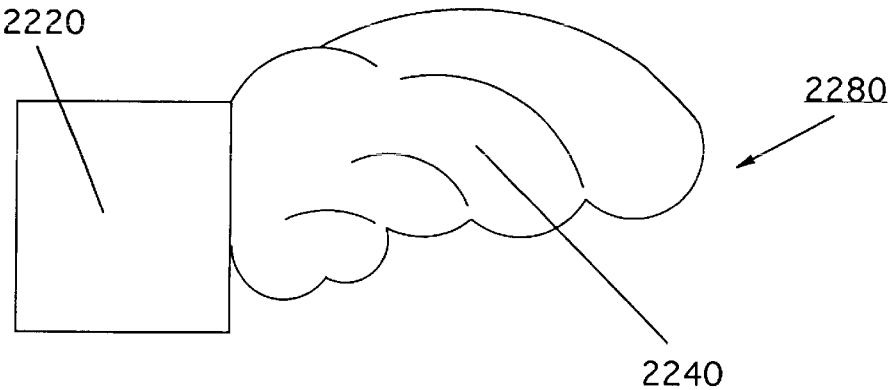
FIG. 26D is a side view of a tool head of a noodle-type personal flotation device comprising an alternative embodiment of the present invention and including a shell shaped paddle tool.

Another exemplary noodle-type flotation device apparatus 2100 comprising an alternative embodiment of the present invention is shown in use in the pictorial view of FIG. 25. In flotation apparatus 2100, a tool head assembly 2180 comprising hand-held water propulsion tool 2140 and mounting cup 2120 is attached to each end of noodle-type personal flotation device 2110. Tool heads 2180 include handles 2142 to assist in working paddle-type propulsion tools 2140. Noodle-type personal flotation device 2110 is of such a length that, when the flotation device is drawn across the back and under the arms of an intended user, handles 2142 of propulsion tool heads 2180 are each correctly positioned for grasping by the left and right hand of the user, respectively. Paddle-type water propulsion tools 2140 of tool heads 2180 allow a user of noodle-type personal floatation apparatus 2100 to propel himself backward in a desired direction by selectively moving tool heads 2180 outward through the water in a generally horizontal plane as indicated by arrows A and B. Tool heads 2180 may then be lifted and moved to their initial position to repeat and continue the propulsive rowing. As with the previous embodiment, propulsion tool heads 2180 might also be worked by grasping mounting cups 2010 or the end portions of flotation device 2110 in immediate proximity to mounting cups 2120. Decorative paddle-type tool head 2280, including a paddle tool shaped as a sea shell, is shown in FIGS. 26A through 26D. Those familiar with the art will recognize that powered propulsive tools can also be utilized to create propulsive tool heads.

While exemplary noodle-type personal flotation device apparatus comprising alternative embodiments of the present invention have been shown, it will be understood, of course, that the invention is not limited to those embodiments. Modification may be made by those skilled in the art, particularly in light of the foregoing teachings. For example, a noodle-type personal flotation device apparatus comprising the present invention might utilize only adhesive to attach a tool head to an end portion of a flotation device. Further, a noodle-type personal flotation device utilized in the apparatus may comprise ridged sections joined by flexible materials such as cloth rather than an extruded, soft, flexible foam material. It is, therefore, contemplated by the appended claims to cover any such modification which incorporates the essential features of this invention or which encompasses the spirit and scope of the invention.

We claim:

1. In a noodle-type personal flotation device including an elongate flotation device body formed of buoyant material and extending to a first distal floatation device body end portion having a first flotation device body end portion surface, the improvement comprising:

the first flotation device body end portion surface defines an end portion orifice; and, the first flotation device body end portion is fabricated of resilient deformable material and includes a first integral, resilient, squeeze-ball pumping bladder in fluid communication with said orifice such that water may be expelled from said first squeeze-ball bladder through said orifice by squeezing the first floatation device body end portion.

2. The improvement of claim 1, further comprising:

a fluid communication conduit extending from a fluid expulsion port of said squeeze-ball pumping bladder to said orifice.

3. The improvement of claim 2, further comprising:

said fluid communication conduit extends from said fluid expulsion port beyond said orifice to form a nozzle.

4. A hand-held tool for use with a noodle-type personal flotation device including an elongate flotation device body formed of buoyant, deformable, closed cell foam material and having a flotation device body end portion with a tubular end portion surface, the tool comprising:

tool means for performing a tool function; and, attachment means for attaching said tool means to the personal flotation device, said attachment means including a base having an outer edge and a tubular wall with a base edge, a distal edge, and an interior wall surface with a wall surface central axis, said base edge joined to said outer edge at a juncture such that said wall and said base form a mounting cup with said central axis generally normal to a juncture plane defined by said juncture; and, said interior surface has a first tubular portion of first geometric cross section shape at a first longitudinal distance along said axis from said juncture plane, a second tubular portion of second geometric cross section shape at a second, greater longitudinal distance along said axis from said juncture plane and a transition portion lying between said first and second portions along said axis and one of said cross sections is sized to surround and embrace the flotation device body end portion.

5. A hand-held tool as in claim 4, further comprising:

said second cross section shape is similar to and larger than said first cross section shape.

6. A hand-held tool as in claim 5, further comprising:

said first and second cross section shapes are each a circle.

7. A hand-held tool as in claim 6, further comprising:

said transition portion is a conical surface.

8. A hand-held tool as in claim 4, further comprising:

said second cross section shape is a circle shape, said first cross section shape is a daisy shape.

9. A hand-held tool as in claim 4, further comprising:

said second cross section shape is a circle shape said first cross section shape is a polygon shape.

10. A noodle-type personal flotation device comprising:

an elongate flotation device body formed of buoyant, flexible, closed cell foam material and extending from a first distal flotation device body end portion to a second distal flotation device body end portion; and, first propulsion hand tool means for generating a propulsive force, said first propulsion hand tool means including a first propulsive force generating surface for causing a propulsive force to result from hand induced movement of said first propulsive force generating surface in water, said first propulsion hand tool means mounted upon said first distal flotation device body end portion.

11. The noodle-type personal flotation device of claim 10, further comprising:

second propulsion hand tool means for generating a propulsive force, said second propulsion hand tool means including a second propulsive force generating surface for causing a propulsive force to result from hand induced movement of said second propulsive force generating surface in water, said second propulsion hand tool means mounted upon said second distal flotation device body end portion.

12. The improvement of claim 11, further comprising:

said first and second propulsion tool means are swim-fin type propulsion tools.

13. The improvement of claim 12, further comprising:

said first and second swim-fin type propulsion tools each include a downward extending handle.

14. The improvement of claim 11, further comprising:

said first and second propulsion tool means are paddle type propulsion tools.

15. The improvement of claim 14, further comprising:

said first and second paddle type propulsion tools each include a downward extending handle.

16. The improvement of claim 11 further comprising:

said first and second distal flotation device body end portions include first and second distal flotation device body end faces, respectively; and, said first and second propulsion tool means are mounted upon said first and second flotation device body end faces, respectively.

17. A propulsion tool for use with a noodle-type personal flotation device, the flotation device including an elongate flotation device body formed of flexible, buoyant, closed cell foam material, the flotation device body extending from a first distal floatation device body end portion having a first floatation device body end face to a second distal floatation device body end portion having a second floatation device body end face, the propulsion tool comprising:

propulsion hand tool means for generating a propulsive force, said propulsion hand tool means including a propulsive force generating surface for causing a propulsive force to result from hand induced movement of said propulsive force generating surface in water; and, attachment means for attaching said propulsion hand tool means to one of said first and second distal floatation device body end portions.

18. The propulsion tool of claim 17 in which said propulsive force generating surface is a paddle type surface.

19. The propulsion tool of claim 17 in which said propulsive force generating surface is a swim-fin type surface.

20. The propulsion tool of claim 17, further comprising said first and second flotation device body end portions have an outer wall and:

said attachment means includes means for embracing the outer wall of one of said first and second distal floatation device body end portions.

* * * * *